US009927112B2

(12) United States Patent
Cox, Jr. et al.

(10) Patent No.: US 9,927,112 B2
(45) Date of Patent: Mar. 27, 2018

(54) UNIVERSAL CORNICE LIGHT FOR PRODUCT DISPLAY

(71) Applicants: George Clinton Cox, Jr., Hamburg, PA (US); Michael Joseph Flynn, Paramus, NJ (US)

(72) Inventors: George Clinton Cox, Jr., Hamburg, PA (US); Michael Joseph Flynn, Paramus, NJ (US)

(73) Assignee: TRINITY, LLC, Metuchen, NJ (US)

( * ) Notice: Subject to any disclaimer, the term of this patent is extended or adjusted under 35 U.S.C. 154(b) by 0 days.

(21) Appl. No.: 14/312,095

(22) Filed: Jun. 23, 2014

(65) Prior Publication Data

US 2014/0376231 A1 Dec. 25, 2014

Related U.S. Application Data

(60) Provisional application No. 61/838,776, filed on Jun. 24, 2013.

(51) Int. Cl.

| | |
|---|---|
| ***F21V 29/70*** | (2015.01) |
| ***F21V 21/30*** | (2006.01) |
| *F21V 15/01* | (2006.01) |
| *F21V 23/00* | (2015.01) |
| *F21W 131/405* | (2006.01) |
| *F21Y 103/10* | (2016.01) |
| *F21Y 115/10* | (2016.01) |

(52) U.S. Cl.

CPC ..... *F21V 29/70* (2015.01); *F21V 21/30* (2013.01); *F21V 15/013* (2013.01); *F21V 23/002* (2013.01); *F21W 2131/405* (2013.01); *F21Y 2103/10* (2016.08); *F21Y 2115/10* (2016.08)

(58) Field of Classification Search

CPC .. F21Y 2013/003; F21V 15/013; F21V 29/70; F21V 21/30; F21V 23/002

USPC ..... 362/294

See application file for complete search history.

(56) References Cited

U.S. PATENT DOCUMENTS

| | | | | |
|---|---|---|---|---|
| 8,376,576 | B2 | 2/2013 | Sloan et al. | |
| 2005/0007033 | A1 | 1/2005 | Kan et al. | |
| 2006/0126325 | A1* | 6/2006 | Lefebvre et al. | 362/217 |
| 2007/0242466 | A1 | 10/2007 | Wu et al. | |
| 2009/0091929 | A1* | 4/2009 | Faubion | 362/234 |

(Continued)

FOREIGN PATENT DOCUMENTS

| | | |
|---|---|---|
| EP | 2 053 666 | 4/2009 |
| WO | WO 2007/090292 | 8/2007 |

*Primary Examiner* — Christopher Raabe

(74) *Attorney, Agent, or Firm* — Cozen O'Connor

(57) ABSTRACT

A light fixture assembly for illuminating a display. The light fixture having a heat sink, a lens, and a body. The heat sink has edges and includes at least one corresponding light emitting diode (LED) board including one or more corresponding LEDs for emitting light. The lens has ending edges and is positioned over the heat sink and LED. The body has an inner wall and an outer wall. The body also has at least two pairs of heat sink mounting channels formed in the inner wall. A first pair of heat sink mounting channels is configured for slidably receiving the edges of the heat sink to provide a first orientation of the corresponding LEDs. A second pair of heat sink mounting channels is configured for slidably receiving the edges of the heat sink to provide a second orientation of the corresponding LEDs, with the first orientation being different than the second orientation.

19 Claims, 9 Drawing Sheets

(56) References Cited

U.S. PATENT DOCUMENTS

| | | | | |
|---|---|---|---|---|
| 2010/0008080 | A1 | 1/2010 | Ivey et al. | |
| 2010/0008085 | A1 | 1/2010 | Ivey et al. | |
| 2010/0019689 | A1 | 1/2010 | Shan | |
| 2011/0286208 | A1* | 11/2011 | Chen | 362/217.1 |
| 2012/0033417 | A1* | 2/2012 | Yen | F21V 19/003 362/217.1 |
| 2013/0044471 | A1 | 2/2013 | Chen | |
| 2013/0335944 | A1 | 12/2013 | Battis | |

* cited by examiner

UNIVERSAL CORNICE LIGHT FOR PRODUCT DISPLAY

CROSS-REFERENCE TO RELATED APPLICATIONS

This application claims the benefit under 35 U.S.C. § 119(e) of U.S. Provisional Application Ser. No. 61/838,776, filed on Jun. 24, 2013, which is hereby incorporated by reference in its entirety.

FIELD OF THE INVENTION

This invention is related to the field of lighting for a product display. More particularly, the present invention pertains to product display lighting capable of being assembled in multiple configurations to provide lighting variety.

BACKGROUND OF THE INVENTION

Light emitting diode (LED) light fixtures have grown in use over the past few years for under-shelf light applications for product display as well as other purposes. However, their use in cornice applications has been limited due to the challenges related to how to effectively illuminate the displayed product(s). Typically, such lighting fixtures are designed to be assembled in a particular way which does not provide versatility for various lighting applications or for mounting the completed assembly in multiple positions in a cornice arrangement wherein the fixture is connected to a product display.

For example, US2013/0335944 to Battis, et al. ("Battis") discloses a light fixture module (as shown in Battis' FIG. 1) consisting of an extruded aluminum core 100 containing an integral heat sink 110, multiple linear arrays of LEDs 200, and a light diffuser (i.e., lens) 300. Diffuser 300 is sealed to an aluminum core 100. The versatility of Battis' light fixture module for providing multiple configurations of lighting is limited as a result of the use of an LED array having a particular shape/configuration. Once the module is assembled, it cannot be reconfigured because diffuser 300 is permanently sealed to aluminum core 100.

U.S. Pat. No. 7,196,196 to Ivey, et al. ("Ivey") discloses a light fixture 11 having an elongate translucent tube 16 which receives a heat sink 14 having an LED circuit board 18. The versatility of Ivey's light fixture 11 is limited to using a heat sink of a particular shape/configuration (as shown in Ivey's FIGS. 5-11) which is placed in the tube 16.

US2013/0044471 to Chen ("Chen") similarly discloses a lighting device (shown in Chen's FIGS. 1-2) having a tubular body 11 and a substrate 12 having light-emitting elements 13 (e.g., LEDs). The versatility of Chen's lighting device is limited to using a substrate of a particular shape/configuration (as shown in Chen's FIGS. 3-5) by placing the substrate in the tubular body 11.

SUMMARY OF THE INVENTION

The invention is related to a lighting assembly for use in product display illumination. In one embodiment, a light fixture assembly for illuminating a display comprises a heat sink, a lens, and a body. The heat sink has edges and includes at least one corresponding light emitting diode (LED) board including one or more corresponding LEDs for emitting light. The lens has ending edges, and is positioned over the heat sink and LEDs. The body has an inner wall and an outer wall. The body also has at least two pairs of heat sink mounting channels formed in the inner wall. A first pair of heat sink mounting channels is configured for slidably receiving the edges of the heat sink to provide a first orientation of the corresponding LEDs, and a second pair of heat sink mounting channels is configured for slidably receiving the edges of the heat sink to provide a second orientation of the corresponding LEDs, with the first orientation being different than the second orientation. The body further has at least one pair of lens mounting channels formed in the outer wall, and each of the at least one pair of lens channels is configured for slidably receiving the ending edges of the lens so that the heat sink is coupled to the body by one of the first or second pairs of mounting channels and the lens is coupled to the body and disposed over the LEDs by the lens mounting channels.

In another embodiment, a light fixture assembly for illuminating a display comprises a heat sink, a lens, a body, a pair of mount and a pair of mounting plates. The heat sink has edges and includes at least one corresponding light emitting diode (LED) board including one or more corresponding LEDs for emitting light. The lens has ending edges, and is positioned over the heat sink and LEDs. The body has an inner wall and an outer wall. The body also has at least two pairs of heat sink mounting channels formed in the inner wall. The pair of mount, each has a mounting member and an extension, and is adapted to be coupled to one end of the body. A first pair of heat sink mounting channels is configured for slidably receiving the edges of the heat sink to provide a first orientation of the corresponding LEDs, and a second pair of heat sink mounting channels is configured for slidably receiving the edges of the heat sink to provide a second orientation of the corresponding LEDs. The first orientation is different than the second orientation. The body further has at least one pair of lens mounting channels formed in the outer wall. Each of the at least one pair of lens channels is configured for slidably receiving the ending edges of the lens so that the heat sink is coupled to the body by one of the first or second pairs of mounting channels and the lens is coupled to the body and disposed over the LEDs by the lens mounting channels. Each mounting member includes a wall having at least one bolt aperture, each adapted for receiving a bolt for fastening each mount to one end of the body, and at least one wire aperture adapted for receiving wires for supplying electric power to the at least one LED board. Each of the mounting plates is interposed between one end of the body and the mount. Each mounting member includes a first set of locking teeth and each mounting plate includes a second set of locking teeth. The body is prevented from rotating about the longitudinal axis when the first set of locking teeth and the second set of locking teeth are interlocked.

Other features of the invention are described below in conjunction with the figures.

DETAILED DESCRIPTION OF THE PRESENTLY PREFERRED EMBODIMENTS

Figure 1A:
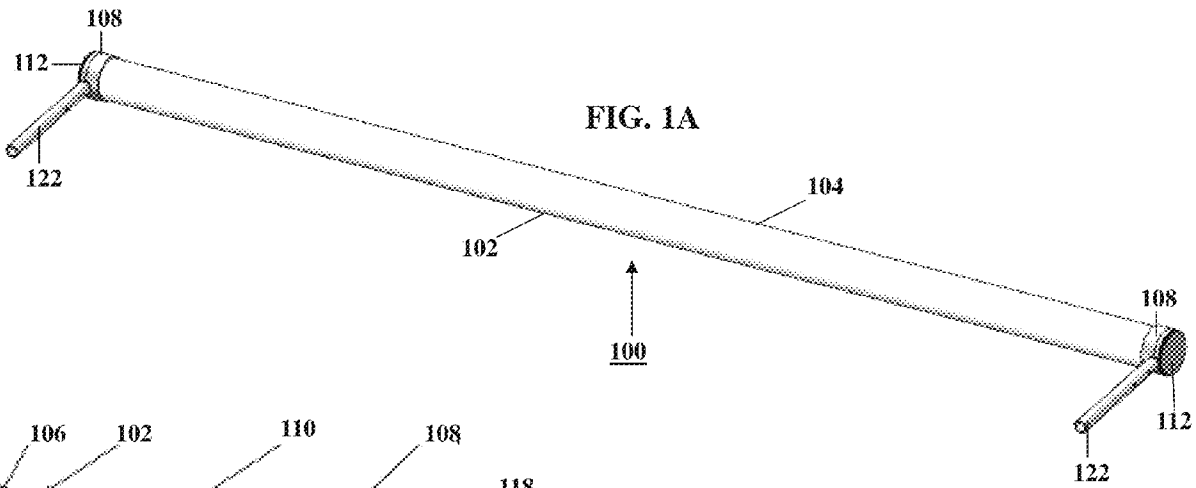
FIG. 1A illustrates a light fixture assembly in accordance with one embodiment of the present invention.
Figure 1B:
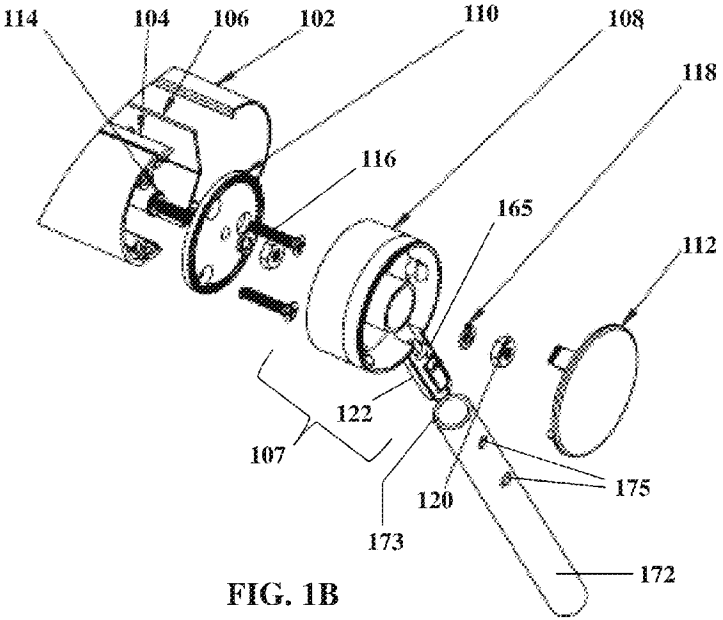
FIG. 1B is an exploded view of one end of the light fixture assembly shown in FIG. 1A in accordance with one embodiment of the present invention.
Figure 1D:
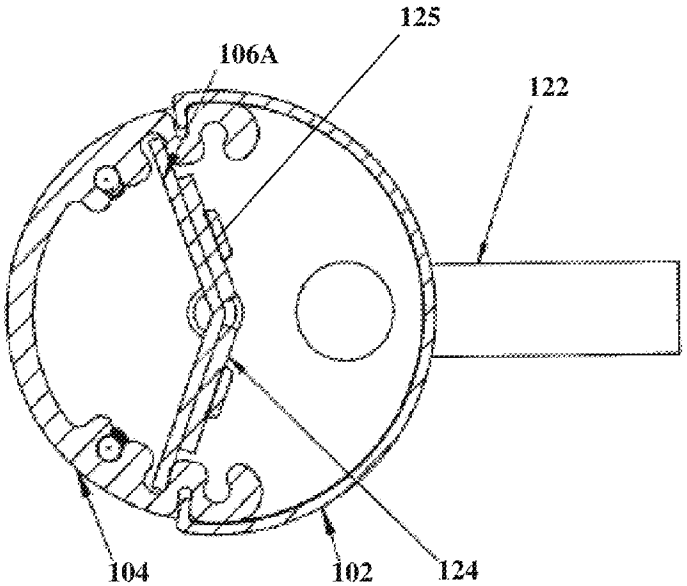
FIG. 1D is a cross section view of a side of the light fixture assembly shown in FIG. 1A in accordance with one embodiment of the present invention.

FIGS. 1A and 1B illustrate a light fixture assembly 100 in accordance with one embodiment of the present invention. Light fixture assembly 100 includes a lens 102, an assembly housing body, and one or more mounts 107 having a mounting member 108 and an extension 122 to connect to each end of the body 104, and an end cap 112 for connecting to each mount 107. The extension 122 is configured as a hollow rod segment having a releasable locking mechanism such as a spring loaded protrusion 165. The rod segment has a diameter dimensioned to seat within a first end 173 of an extension arm 172, with the other end of the extension arm capable of being fastened to a display or other structure. The first end 173 includes one or more holes 175 which receive protrusion 165 when the extension 122 is seated in the first end 173. The parts can be separated by pushing the button into one of the holes 175 and pulling the parts away from each other. In addition, the protrusion 165 is slidable within a slot on the extension 122 to provide for flexibility and adjustment when connecting extension arm 172 to extension 122.

Assembly housing body 104 includes two or more pairs of mounting channels (128, 128' and 130, 130' as shown in FIGS. 1D-1G and 2B). Each of the two or more pairs of mounting channels is configured for receiving, in a slidable manner, a heat sink 106 and, in particular, edges 137 of the heat sink 106. With multiple pairs of mounting channels (e.g., 128 and 128', 130, 130') to choose from when engaging heat sink 106 with housing 104, light fixture assembly 100 can readily meet varying customer needs by positioning heat sink 106 into one or another of the pair of mounting channels to accommodate a variety of lighting configurations. Thus, and as described more fully below, light fixture assembly 100 provides for the use of multiple configurations of LEDs 125 (shown in FIGS. 1D-1G) to yield different lighting solutions.

In some embodiments, the two or more pairs of mounting channels (128, 128' and 130, 130') are adapted, or dimensioned, to provide a friction fit with edges 137 of heat sink 106. In some embodiments, such friction-fit mounting channels provide sufficient force to secure heat sink 106 in place in the channels with respect to the body 104, thus preventing heat sink 106 from unintended sliding along mounting channels (128, 128' and 130, 130').

The housing body 104 also includes one or more pairs of lens channels 126, 126' (shown in FIG. 2B) positioned on a side opposite the side containing the mounting channels (128, 128', 130, 130). The lens channels receive edges 134 of lens 102 to removably affix lens 102 to assembly housing body 104 as explained below. In some embodiments, assembly housing body 104 is made of aluminum and, preferably, by extrusion. In some embodiments, lens 102 is configured to provide a filter or diffuser for the light radiating from LED(s) 125 on LED board 124 (shown in FIGS. 1D-1G). In some embodiments, lens 102 is made of any number of extruded plastics.

Figure 1C:
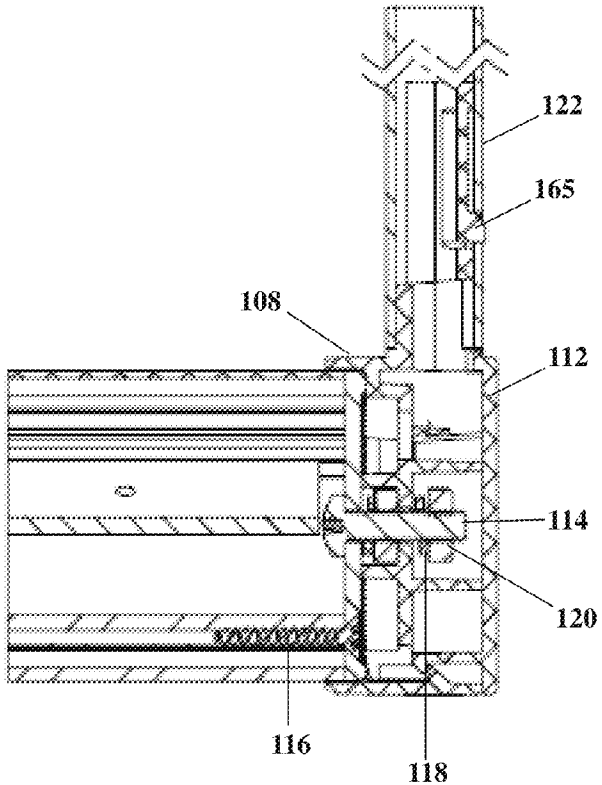
FIG. 1C is a longitudinal cross section view of one end of the light fixture assembly shown in FIG. 1A in accordance with one embodiment of the present invention.
Figure 1F:
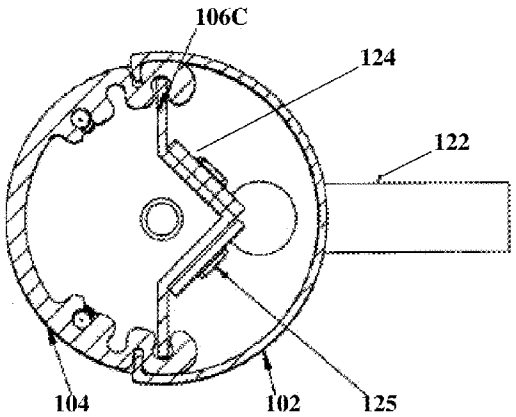
FIGS. 1E-1G show a cross section of a side of the light fixture assembly configured for heat sinks of different shapes and orientations in accordance with one embodiment of the present invention.
Figure 1E:
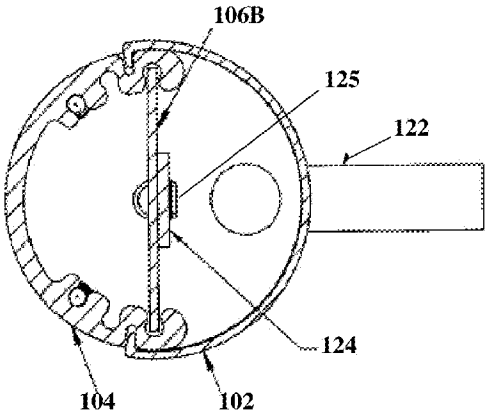
Figure 1G:
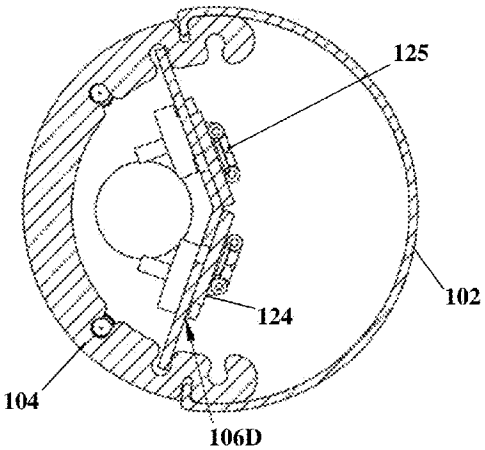
Figure 1H:
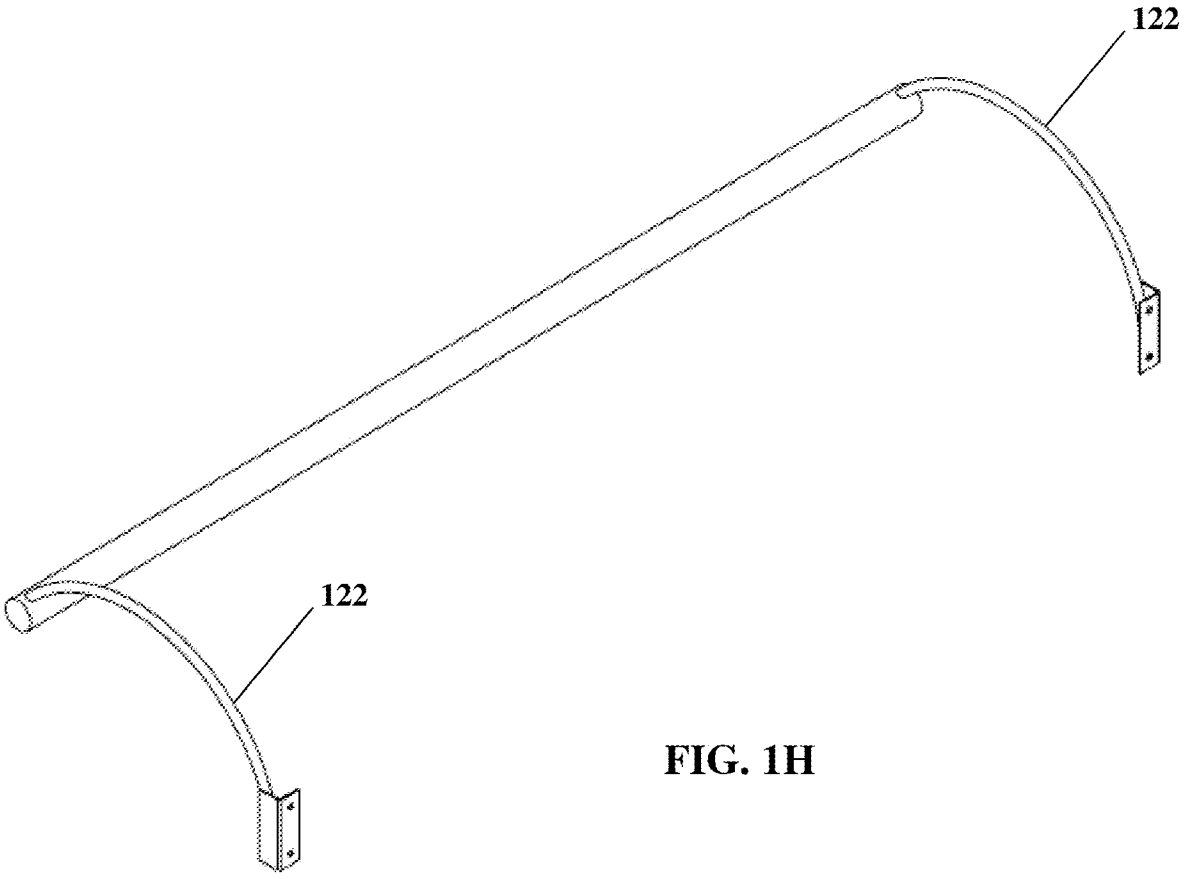
FIG. 1H illustrates a light fixture assembly having an arched hanger bar that can be deployed as an overhead lighting fixture for product displays in a point-of-purchase assembly in accordance with one embodiment of the present invention.
Figure 2A:
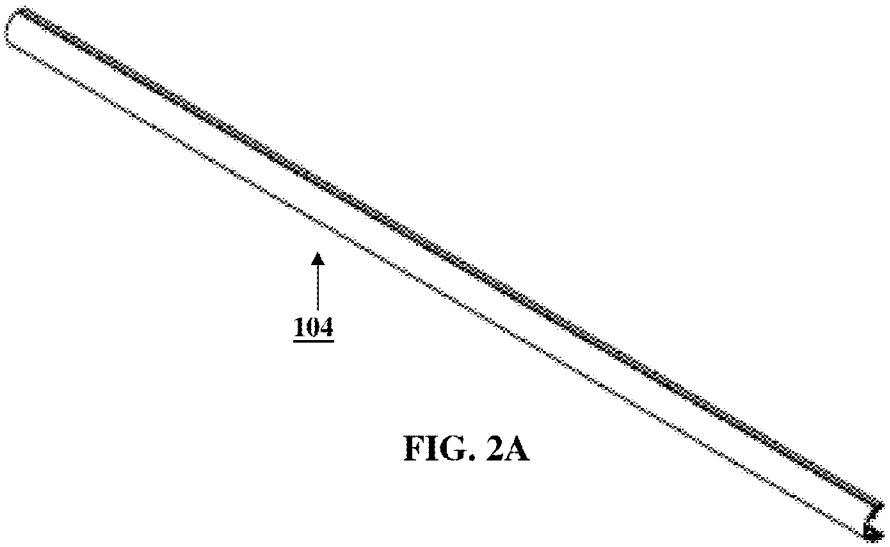
FIG. 2A illustrates an assembly housing body of a light fixture assembly in accordance with one embodiment of the present invention.
Figure 2B:
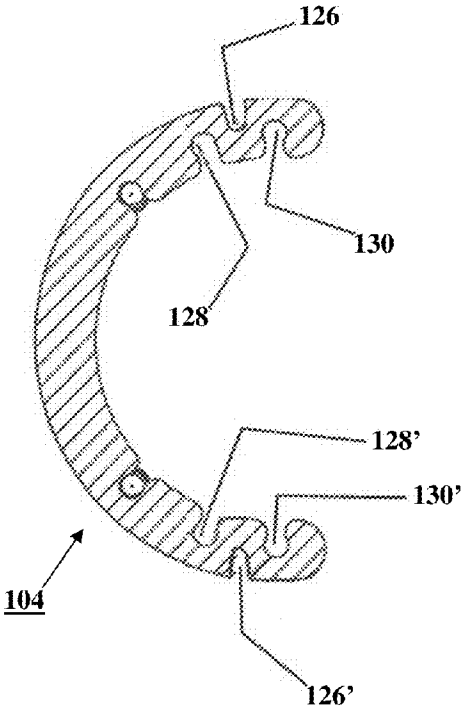
FIG. 2B is a cross section view of the assembly housing body shown in FIG. 2A in accordance with one embodiment of the present invention.
Figure 3A:
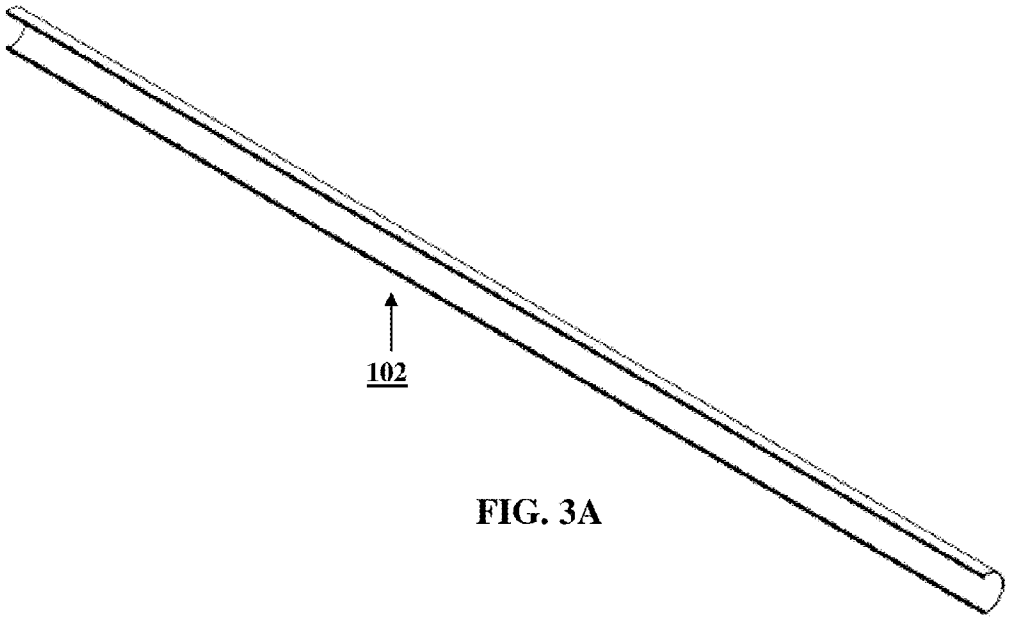
FIG. 3A illustrates a lens for the light fixture assembly shown in FIG. 1A in accordance with one embodiment of the present invention.
Figure 3B:
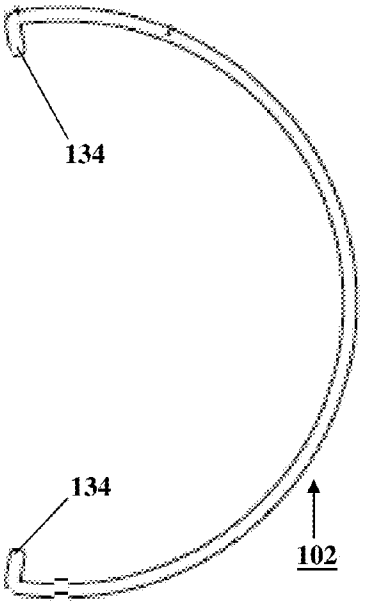
FIG. 3B is a cross section view of the lens shown in FIG. 3A in accordance with one embodiment of the present invention.

In some embodiments, extension arm 172 is configured as an arched hanger bar. In some embodiments, light fixture assembly 100 having an arched hanger bar is deployed, as shown in FIG. 1H, as a cornice lighting fixture for product displays in point-of-purchase assemblies. For example, light fixture assembly 100 may be attached as a cornice assembly to an end portion of a cosmetic display for illuminating product(s) positioned on the display shelves.

FIG. 1B illustrates an exploded view of one end of light fixture assembly 100 in accordance with one embodiment of the present invention. In addition to lens 102, assembly housing body 104, and mounts 107 having extensions 122 and mounting members 108, light fixture assembly 100 further comprises one or more heat sinks 106 and a pair of adjustable mounting plates 110.

Heat sink 106 which, in a preferred embodiment is formed of extruded aluminum includes one or more light emitting diode (LED) boards 124, each having one or more LEDs 125. Heat sink 106 is slidably engaged with one of the pairs of mounting channels (e.g., 128, 128' and 130, 130') in housing body 104 by aligning edges 137 with an end of one of the mounting channel pairs (e.g., 128, 128') and sliding heat sink 106 along the length of assembly body 104 to a desired position. Each of the two or more pairs of the mounting channels is at different orientations to provide different lighting angles.

In some embodiments, heat sink 106 comprises at least two heat sink segments, each having edges (e.g., edges 137) and one or more LED boards 124. In some embodiments, two or more heat sink segments are coupled by power supply lines soldered to one end of LED board 124 that is included in each of the segments. In some embodiments, heat sink segments of different shapes/configurations are combined to form heat sink 106 for light fixture assembly 100. In some embodiments, such combined heat sink segments extend the full length of light fixture assembly 100, whereas in other embodiments, particularly where a relatively strong friction fit is provided between the body channels and the heat sink segments, the heat sink segments can be spaced apart and held in desired places in light fixture assembly 100. In particular when the heat sink segments, positioned end-to-end do not substantially equal to the length of the body 104, the tight friction fit with the channels will limit or prevent movement of the heat sink segments along the length of the body.

Figure 4A:
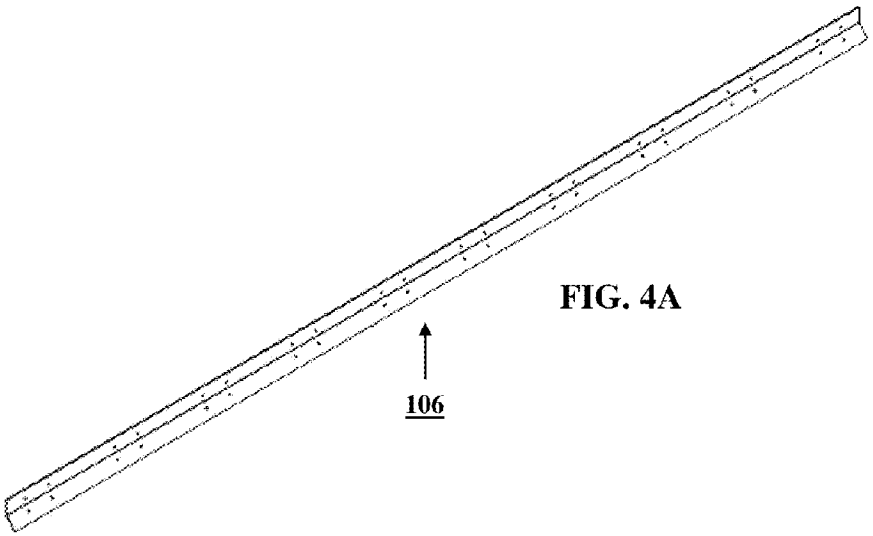
FIG. 4A illustrates a heat sink that can be used in a light fixture assembly in accordance with one embodiment of the present invention.
Figure 4B:
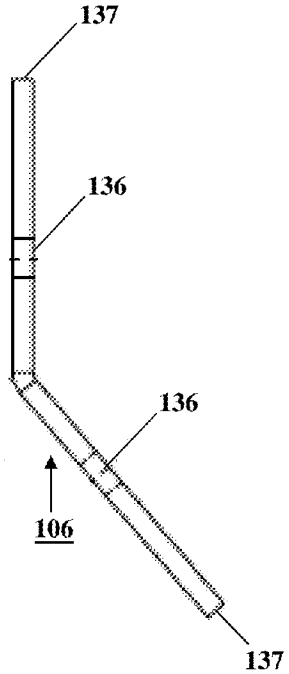
FIG. 4B is a cross section view of the heat sink shown in FIG. 4A in accordance with one embodiment of the present invention.

In some embodiments, LEDs of different types (e.g., LEDs with high luminance or low luminance, LEDs that flicker slowly or rapidly, etc.) are mounted to the same heat sink. In FIG. 1F, for instance, LEDs 125 formed on one side of heat sink 106 may be of a different type than LEDs 125 formed on the other side of heat sink 106. In some embodiments, LED boards 124 are coupled to heat sink 106 via screw holes or solder points 136 (shown in FIG. 4B). In some embodiments, LEDs 125 receive electrical power through one or more power supply lines soldered to one end of LED board 124.

Each mounting plate 110 includes a plurality of teeth 140 (shown in FIG. 7) and also includes one or more holes 142, 143 for affixing the mounting plates to each end of the assembly. Preferably, two of the holes 142 are countersunk and are used for receiving fastening hardware, and hole 143 is used as a passageway for electrical wiring from the LED's to connect to a power supply, such as an AC outlet. In some embodiments, as also shown in FIG. 1C, plate 110 is fastened to each end of light fixture assembly 100 using one or more screw bolts 116. Mounting member 108 is fastened to each end of light fixture assembly 100 using a set of a bolt 114, a washer 118, and a nut 120. The assembly end is then covered with an end cap 112 which is configured to attach, in a snap fit connection, to a side of mounting member 108 which is opposite a side connecting to mounting plate 110 (FIG. 1B).

The channels 128, 128' and 13, 130' within light fixture assembly 100, coupled with different configurations of heat sinks 106A-106D (as shown in FIGS. 1D-1G), allows LED lighting to be focused in different ways, using the same body 104 and lens 102. When the assembly is mounted to a product display, a so-called universal cornice system can produce a variety of lighting depending on the mounting channels used, the types of LED's, the heat sink configuration, and the orientation of the assembly by way of the mounting plate 110.

Figure 5B:
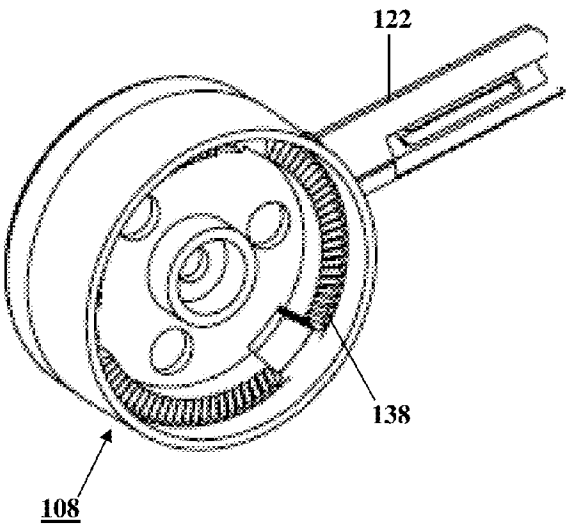
FIG. 5B is a diagram of the arm shown in FIG. 5A showing a side of the arm configured to couple to the light fixture assembly shown in FIG. 1A in accordance with one embodiment of the present invention.
Figure 5A:
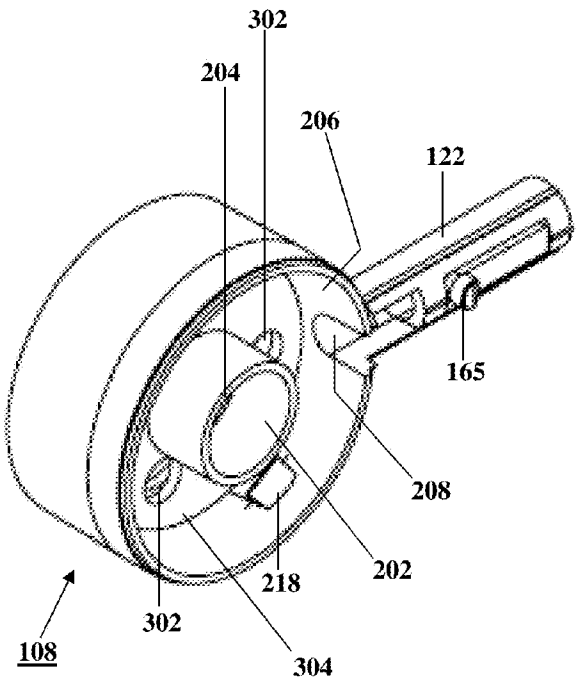
FIG. 5A is a diagram of the arm shown in FIG. 1B illustrating a side configured to receive an end cap in accordance with one embodiment of the present invention.
Figure 6:
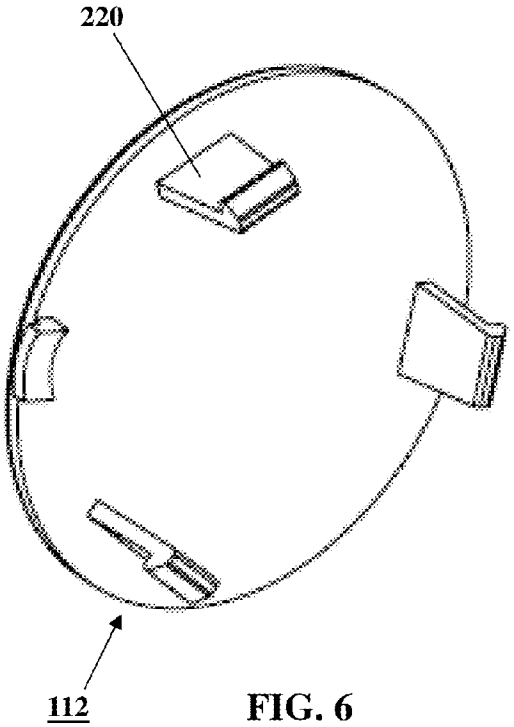
FIG. 6 illustrates an end cap for an arm of the light fixture assembly shown in FIGS. 1A-1B in accordance with one embodiment of the present invention.

FIG. 5A shows mount 107 formed as an integral component containing mounting member 108 and extension 112. Mount 107 is preferably molded of plastic material. Alternatively, components 122 and 108 can be separate pieces and connected together in any known manner. Mounting member 108 includes a wall 304 having a plurality of holes 302 therein, FIG. 5A shows two such holes, but three are preferred and are equi-angularly spaced about a central cavity 202 bounded by a skirt 204. The mounting member 108 also includes an outer wall 206 having a notch 208 formed therein which provides access to extension 122, which is preferably hollow. Also as shown, mounting member 108 includes one or more angled clips 218 for engaging the end cap 112, as explained below.

Mounting member 108 on the side shown in FIG. 5B is coupled to one end of light fixture assembly 100 and includes a plurality of locking teeth 138. Locking teeth 138, when interlocked with teeth 140 on plate 110 (shown in FIG. 7), prevent light fixture assembly 100 from rotating about the longitudinal axis of body 104. The locking teeth arrangement provides for a variety of orientations of the housing 104 with respect to the mounting plate 110 which allows for flexibility in lighting. Once the teeth of plate 110 are mated with teeth on mounting member 108, holes 142 will substantially align with two of the three holes 302 so that a fastener such as a screw can fasten the components together. The conductive wiring will extend through hole 143 and through the remaining hole 302 in the mounting member 108, through the notch 208 and through hollow extension 122 wherein the wiring can be connected to a power supply, such as an electrical outlet.

Once the wiring is fed through extension 122, the end cap 112 can be attached to mount 107. In this regard, end cap 112 includes one or more angled clips 220 having a hooked end which engage one or more of clips 218 to provide an aesthetic and protective cover to the assembly. Clips 220 are preferably molded with cap 112. Once end cap 112 is in place, it can be removed with a prying force to disengage hooks 220 and 218 from each other, such as in the event the assembly requires repair, servicing, reconfiguration or the like.

Figure 7:
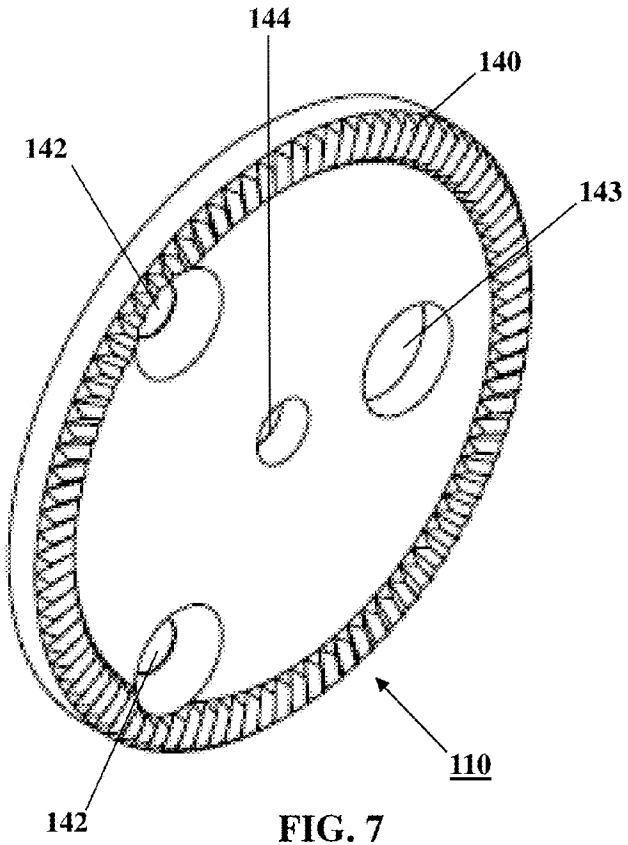
FIG. 7 illustrates a cap for an arm of the light fixture assembly shown in FIGS. 1A-1B in accordance with one embodiment of the present invention.

Though FIG. 5B and FIG. 7 illustrate, respectively, locking teeth 138 formed in substantially the full circumferential length around mounting member 108 and locking teeth 140 formed in the full circumferential length around plate 110, it is also possible that locking teeth 138, 140 may be formed in only portion(s) of member 108 and/or plate 110.

For assembly, a heat sink configuration will be selected and LED's will be mounted thereto based on the lighting requirements of a particular application. The heat sink with LEDs can then be slidably inserted into the mounting channels (128, 128') depending on the desired orientation of the light. The heat sink may comprise two or more heat sink segments of different configurations befitting different pairs of heat sink mounting channels and/or having different types of LEDs. For example, the heat sink may consist of three heat sink segments (e.g., first, second, third heat sink segments), wherein the first and third heat sink segments are configured to befit mounting channels 128, 128' and placed at either end of the light fixture assembly while the second heat sink segment is configured to befit mounting channels 130, 130' and placed in the middle of the light fixture assembly. Any number of different combinations of heat sink segments may be used to form the heat sink for the light fixture assembly. One or more of the three heat sink segments may have different types of LEDs as well.

Once the heat sink is in place and the wiring fed through hole 143 on plate 110, the lens 102 can be attached to the housing 104 using lens channels 126, 126' such as by sliding. The lens may have a surface including one or more light diffracting structures and/or have different surface color for different filtering effects. Thereafter the light fixture assembly will be completed by attaching the mounting plate(s) 110, mount member(s) 108, and end cap(s) 112 and orienting the mount member 108 by engagement of teeth 138 as described above. The face ends of extension 122 can then be attached such as by brackets, screws or other fasteners to a display.

While there have shown and described and pointed out fundamental novel feature of the invention as applied to preferred embodiments thereof, it will be understood that various omissions and substitutions and changes in the form and details of the light fixture assembly illustrated, and in their operation/steps, may be made by those skilled in the art without departing from the spirit of the invention. For example, it is expressly intended that all combinations of those elements and/or steps which perform substantially the same function in substantially the same way to achieve the same results are within the scope of the invention.

Moreover, it should be recognized that structures and/or elements and/or steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A light fixture assembly for illuminating a display, comprising:

one selected from among a first type of heat sink and a second type of heat sink, each of the first and second types of heat sinks having edges and each including at least one corresponding light emitting diode (LED) board including one or more corresponding LEDs for emitting light, the edges of the first type of heat sink being coplanar with one another and the edges of the second type of heat sink being oblique with one another;

a lens having ending edges and positioned over the selected type of heat sink and LEDs; and a body having an inner wall and an outer wall, said body having a first pair of heat sink mounting channels formed in the inner wall and a second pair of heat sink mounting channels formed in the inner wall, wherein the first pair of heat sink mounting channels is configured for slidably receiving said coplanar edges of said first type of heat sink to provide a first orientation of the corresponding LEDs and the second pair of heat sink mounting channels is configured for slidably receiving said oblique edges of said second type of heat sink to provide a second orientation of the corresponding LEDs, with said first orientation being different than said second orientation; and said body having at least one pair of lens mounting channels formed in the outer wall of the body, wherein each of said at least one pair of lens mounting channels is configured for slidably receiving into the body said ending edges of said lens, said selected type of heat sink being coupled to said body by only one or the other of said first or second pairs of heat sink mounting channels and said lens being coupled to said body and disposed over said LEDs by said at least one pair of lens mounting channels.

2. The light fixture assembly of claim 1, further comprising a pair of mounts, each having a mounting member and an extension, and adapted to be coupled to one end of said body.

3. The light fixture assembly of claim 2, wherein said mounting member further comprises a wall having at least one bolt aperture, each adapted for receiving a bolt for fastening said mount to said one end of said body, and at least one wire aperture adapted for receiving wires for supplying electric power to said at least one LED board.

4. The light fixture assembly of claim 2, wherein said extension is at least partially hollow, and is adapted to provide a passageway for electrical wires for supplying electric power to said at least one LED board.

5. The light fixture assembly of claim 2, further comprising a pair of mounting plates, wherein each mounting plate is interposed between said one end of said body and said mount.

6. The light fixture assembly of claim 5, wherein said each mounting member includes a first one or more locking teeth and said each mounting plate includes a second one or more locking teeth for selective engagement with said first one or more locking teeth, and wherein said body is prevented from rotating about a longitudinal axis of said body when said first one or more locking teeth and said second one or more locking teeth are engaged.

7. The light fixture assembly of claim 1, wherein each pair of said heat sink mounting channels provides an orientation for accommodating, with respect to said body, a particular one of said first or second type of heat sink.

8. The light fixture assembly of claim 1, wherein said body is formed from extruded aluminum.

9. The light fixture assembly of claim 1, wherein the length of each of said first or second type of heat sink is substantially the same as the length of said body.

10. The light fixture assembly of claim 1, wherein said second type of heat sink comprises at least two heat sink segments, each having edges and including one or more of said at least one LED board.

11. The light fixture assembly of claim 10, wherein said at least two heat sink segments, when combined, form said second type of heat sink with a length that is substantially the same as the length of said body.

12. The light fixture assembly of claim 11, wherein said at least two heat sink segments are received by more than one of said at least two heat sink mounting channels.

13. The light fixture assembly of claim 10 wherein each of said at least two heat sink segments are spaced apart from one another along the length of said body and wherein said pairs of heat sink mounting channels are adapted to provide a friction-fit for said edges of said second type of heat sink.

14. The light fixture assembly of claim 13, wherein said friction-fit is adapted to hold said second type of heat sink in place.

15. The light fixture assembly of claim 1, wherein said lens is formed from an extruded plastic.

16. The light fixture assembly of claim 1, wherein said lens is adapted to filter the light radiating from said one or more LEDs on said at least one LED board.

17. The light fixture assembly of claim 1, wherein said first type of heat sink comprises a planar heat sink and said second type of heat sink comprises a non-planar bent heat sink.

18. The light fixture assembly of claim 1, wherein a type of said corresponding LEDs of one or more of said at least one LED board is different from the type of said corresponding LEDs of the rest of said at least one LED board.

19. A light fixture assembly for illuminating a display, comprising:

one selected from among a first type of heat sink and a second type of heat sink, each of the first and second types of heat sinks having edges and each including at least one corresponding light emitting diode (LED) board including one or more corresponding LEDs for emitting light, the edges of the first type of heat sink being coplanar with one another and the edges of the second type of heat sink being oblique with one another;

a lens having ending edges and positioned over the selected type of heat sink and LEDs;

a body having an inner wall and an outer wall, said body having at least two pairs of heat sink mounting channels formed in the inner wall;

a pair of mounts, each having a mounting member and an extension, with each mount adapted to be coupled to an end of said body; and a pair of mounting plates, wherein a first pair of heat sink mounting channels is configured for slidably receiving said coplanar edges of said first type of heat sink to provide a first orientation of the corresponding LEDs, and a second pair of heat sink mounting channels is configured for slidably receiving said oblique edges of said second type of heat sink to provide a second orientation of the corresponding LEDs, with said first orientation being different than said second orientation, and said body further having at least one pair of lens mounting channels formed in the outer wall, wherein each of said at least one pair of lens mounting channels is configured for slidably receiving said ending edges of said lens, said selected type of heat sink being coupled to said body by only one or the other of said first or second pairs of heat sink mounting channels and said lens being coupled to said body and disposed over said LEDs by said lens mounting channels, wherein said each mounting member includes a wall having at least one fastening aperture, each adapted for receiving a fastener for fastening said each mount to said one end of said body, and at least one wire aperture adapted for receiving wires for supplying electric power to said at least one LED board, wherein each of said mounting plates is interposed between said one end of said body and said mount, wherein said each mounting member includes a first one or more locking teeth and said each mounting plate includes a second one or more locking teeth for selective engagement with said first one or more locking teeth, and wherein said body is prevented from rotating about a longitudinal axis of said body when said first one or more locking teeth and said second one or more locking teeth are engaged a first set of locking teeth and said each mounting plate includes a second set of locking teeth.

* * * * *